United States Patent [19]

Pell

[11] 4,026,136

[45] May 31, 1977

[54] METHOD AND APPARATUS FOR CHANGING ROLLS FOR A ROLLING MILL

[75] Inventor: Raymond H. Pell, Chesterton, Ind.

[73] Assignee: National Steel Corporation, Pittsburgh, Pa.

[22] Filed: Apr. 13, 1976

[21] Appl. No.: 676,577

Related U.S. Application Data

[62] Division of Ser. No. 431,320, Jan. 7, 1974, Pat. No. 3,951,268.

[52] U.S. Cl. ..... 72/238; 29/401 F; 29/281.1

[51] Int. Cl.[2] ..... B21B 31/08

[58] Field of Search ..... 72/238, 239; 29/200 D; 211/64, 60, 4

[56] References Cited

UNITED STATES PATENTS

| | | | |
|---|---|---|---|
| 991,736 | 5/1911 | Minnick | 211/60 R |
| 2,946,452 | 7/1960 | Caloiero et al. | 211/64 X |
| 3,323,345 | 6/1967 | Lyle et al. | 72/239 |
| 3,531,969 | 10/1970 | Amino et al. | 72/239 |

*Primary Examiner*—Milton S. Mehr
*Attorney, Agent, or Firm*—Shanley, O'Neil and Baker

[57] ABSTRACT

Arrangement including the use of at least two novel dual work roll supporting devices for supporting new or refinished work rolls on one device and a used work roll and mounted chock assemblies on another device, in the same relative relationship to permit removal of the chock assemblies as units from the used work rolls and mounting of the chock assemblies on new or refinished work rolls without requiring disengagement of the top and bottom work roll chocks.

7 Claims, 8 Drawing Figures

METHOD AND APPARATUS FOR CHANGING ROLLS FOR A ROLLING MILL

This is a division, of application Ser. No. 431,320, filed Jan. 7, 1974, now U.S. Pat. No. 3,951,268.

FIELD OF THE INVENTION

This invention relates to the changing of rolls of a rolling mill of the type in which top and bottom work rolls and their supporting chock assemblies are removed from and returned to the rolling mill as unitary structures. More particularly, the present invention relates to a method of and apparatus for removing chock assemblies from used top and bottom work rolls when outside the rolling mill and for mounting such chock assemblies on new or refinished top and bottom work rolls to provide a unitary structure for placement in the rolling mill.

BACKGROUND OF THE INVENTION

In accordance with conventional practice, top and bottom work rolls and their supporting chock assemblies are removed from or moved into a rolling mill as unitary structures by means of tracks located on the operating side of the mill which extend in a direction parallel to the axes of the work rolls. In the case of used top and bottom work rolls, the unitary structure is lifted from the tracks and placed on a transport car and moved to the roll shop. In accordance with the prior art practice, the following operations are performed at the roll shop to remove chock assemblies from used work rolls and to mount such chock assemblies on new or refinished top and bottom work rolls to provide a unitary structure to be returned to and mounted in the rolling mill:

1. Disengage both chock assemblies to permit the top work roll and its chock to be removed from the bottom work roll and its chocks.
2. Lift the top work roll and its chocks and place on a first support with the outer end portions of the working surface of the top work roll supported on wooden blocks and with each chock located above a path of movement of a different chock car.
3. Lift the bottom work roll and its chocks and place on a second support similar to the first support with the chocks located above the path of movement of the chock cars.
4. Place two new or refinished work rolls on separate supports similar to the first support with both ends of each work roll overlying the path of movement of the chock cars.
5. By use of chock cars, remove the chocks from the used top work roll and mount the chocks on a new or refinished work roll.
6. By use of the chock cars, remove the chocks from the used bottom work roll and place the chocks on a new or refinished work roll.
7. Lift from the support the new or refinished work rolls with chocks thereon and place the assembly on the transport car.
8. Lift from the support the new or refinished top work rolls with chocks thereon and place that assembly on the new or refinished bottom work roll and assembled chocks supported by the transport car.
9. Re-engage the chocks on the new or refinished top and bottom work rolls at both ends of the work rolls to provide a unitary structure of new or refinished work rolls and chock assemblies for movement to the rolling mill.

It is a primary object of the present invention to eliminate many of the foregoing operational steps of the prior art practice and provide essentially a four-step process which materially reduces the time required to make up a unitary structure of new or refinished work rolls and chock assemblies using chock assemblies from a unitary structure including used work rolls.

This object is achieved by a novel method and apparatus provided by the present invention for removal of chock assemblies from the top and bottom used work rolls and placing of such chock assemblies on new or refinished top and bottom work rolls which eliminates the necessity and the attendant prior art operational steps of disengaging from each other the top work roll chock and the bottom work roll chock of the chock assemblies.

Other objects and features of the present invention will appear from the following detailed description considered with the accompanying drawings which illustrate the preferred embodiment of the invention.

DESCRIPTION OF PRIOR ROLLING MILL APPARATUS

Figure 1:
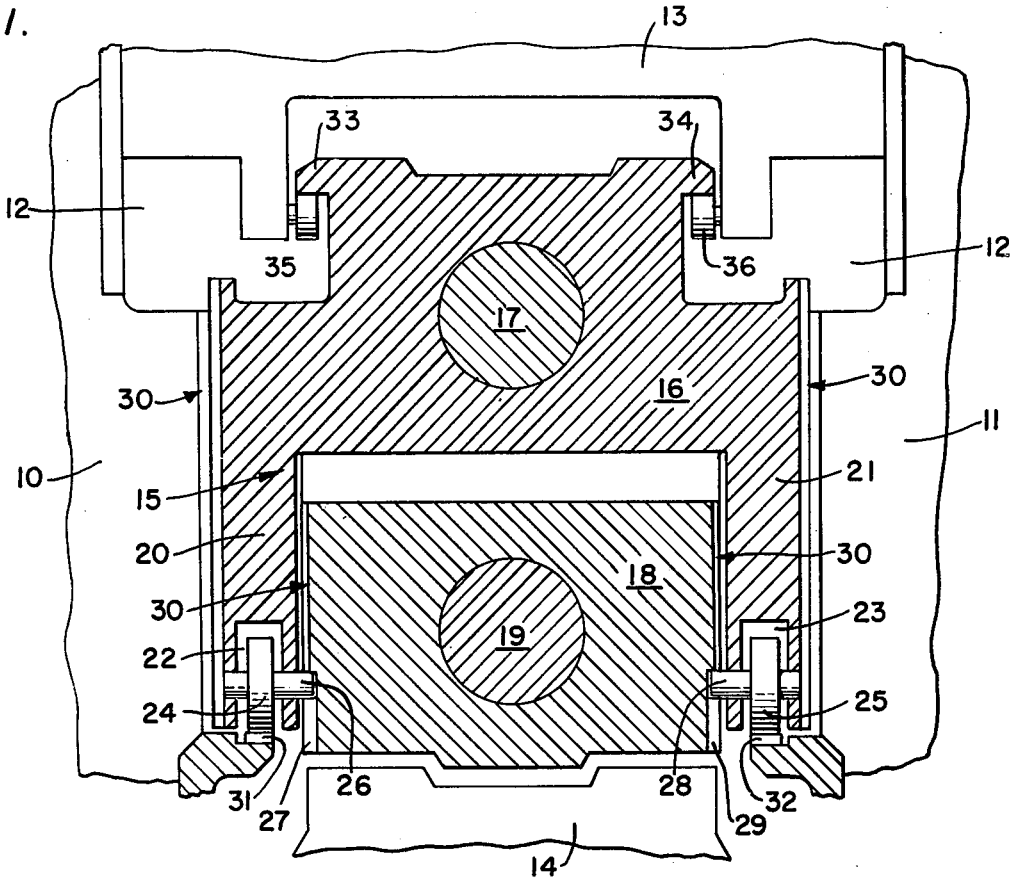
FIG. 1 is a fragmentary diagrammatic showing, partially in section, of a rolling mill with the top and bottom work rolls and the chock assembly positioned to be removed from the rolling mill as a unitary structure.

As mentioned above, it is common practice in the art of rolling mills to provide structure that permits the top work roll and the bottom work roll and the chock assemblies at both ends of the work rolls to be removed from the rolling mill or to be moved into the rolling mill as a unitary structure. A typical arrangement shown in FIG. 1 includes upright housings 10 and 11 providing a window 12 within which is mounted a chock 13 for the top backup roll, not shown, a chock 14 for the bottom backup roll, not shown, and a chock assembly 15 including chock 16 for the top work roll 17 and chock 18 for the bottom work roll 19. The top work roll chock 16 is provided with a pair of spaced-apart, downwardly depending leg portions 20 and 21 between which is nested the bottom work roll chock 18. The lower ends of the leg portions 20 and 21 are provided with downwardly openings slots 22 and 23, respectively, in each of which is mounted a wheel 24 and 25, respectively. The wheel 24 is supported by a shaft 26 which extends laterally into a downwardly open end slot 27 formed in the adjacent surface of the lower work roll chock 18. Similarly, the wheel 25 is supported by a shaft 28 which extends laterally into a downwardly open end slot 29 formed in the opposite adjacent surface of the bottom work roll chock 18. Thus, the bottom work roll chock 18 is movable relative to the top work roll chock 16 and the extent of relative downward movement is limited by engagement of shafts 26 and 28 with the closest ends of slots 27 and 29, respectively. In accordance with conventional practice, liners 30 may be provided where there is relative movement between adjacent surfaces of the top and bottom work roll chocks 16 and 18 and between the housings 10 and 11 and the chocks 13, 14 and 16.

FIG. 1 shows the top and bottom work rolls and their chock assemblies positioned to be removed from the rolling mill as a unitary structure. Upward movement of the top backup roll chock 13 positions the top work roll chock 16 to be supported by the wheels 24 and 25 which ride on rails 31 and 32, respectively, supported by the housings, and by outwardly extending portions 33 and 34 of the top work roll chock 16 which ride on wheels 35 and 36, respectively, supported by the top backup roll chock 13. The bottom work roll chock 18 is supported by the shafts 26 and 28 in contact with the closed ends of respective slots 27 and 28 and is in its maximum downward positions relative to the top work roll chock 16. When the bottom work roll chock 18 is at its maximum downward position, the top surface 37 of the lower work roll chock 18 is spaced vertically a maximum distance from the adjacent bottom surface 38 of the top work roll chock 16.

Figure 2:
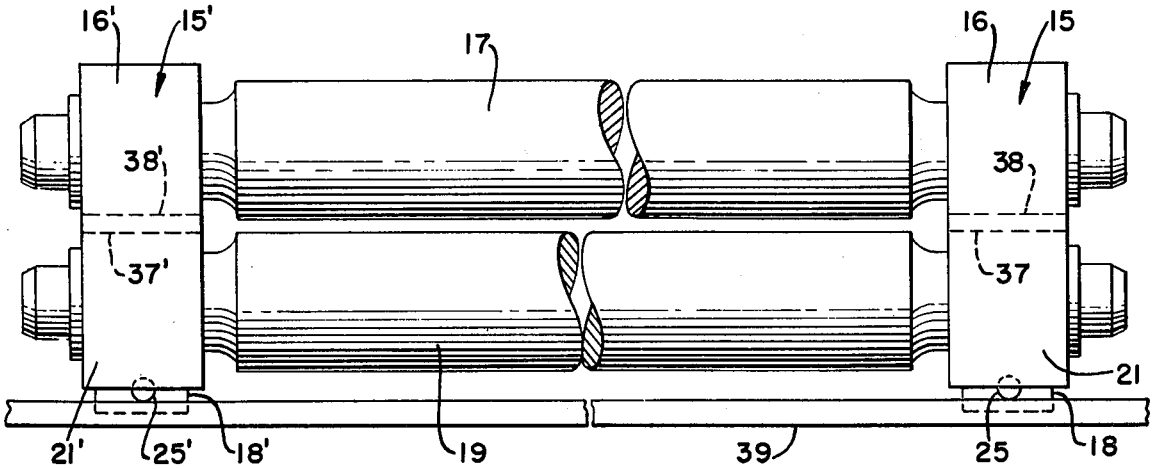
FIG. 2 is a diagrammatic view in side elevation of a unitary structure including top and bottom work rolls and chock assemblies positioned outside the rolling mill.

Parallel tracks, which are extensions of the rails 31 and 32, are provided on the operating side of the rolling mill to permit the top and bottom work rolls and each chock assembly to be removed from the mill as a unitary structure. FIG. 2 illustrates such unitary structure located outside the rolling mill, the chock assembly for the other ends of the working rolls and its component parts being designated by primed reference characters. As shown, the unitary structure is supported on track 39 by wheels 25 and 25', the other parallel track and the supporting wheels not shown in the drawing.

In the case of a unitary structure including used work rolls, from the position shown in FIG. 2 the unitary structure is lifted and placed on a transfer car where the structure is supported by the lower work roll chocks 18 and 18', and moved to the roll shop where the novel method and apparatus provided by the present invention are practiced.

DESCRIPTION OF PREFERRED EMBODIMENT

The present invention provides a novel dual work roll supporting device for supporting as a unitary structure the top and bottom work rolls and a mounted chock assembly at both ends of the work rolls in such a manner as to permit each chock assembly to be removed from the work rolls as a unitary stucture, that is, without requiring disengagement of the top work roll chock and the bottom work roll chock, and to thereafter mount each removed chock assembly on a pair of new or refinished work rolls supported by a similar dual work roll supporting device.

Figure 3:
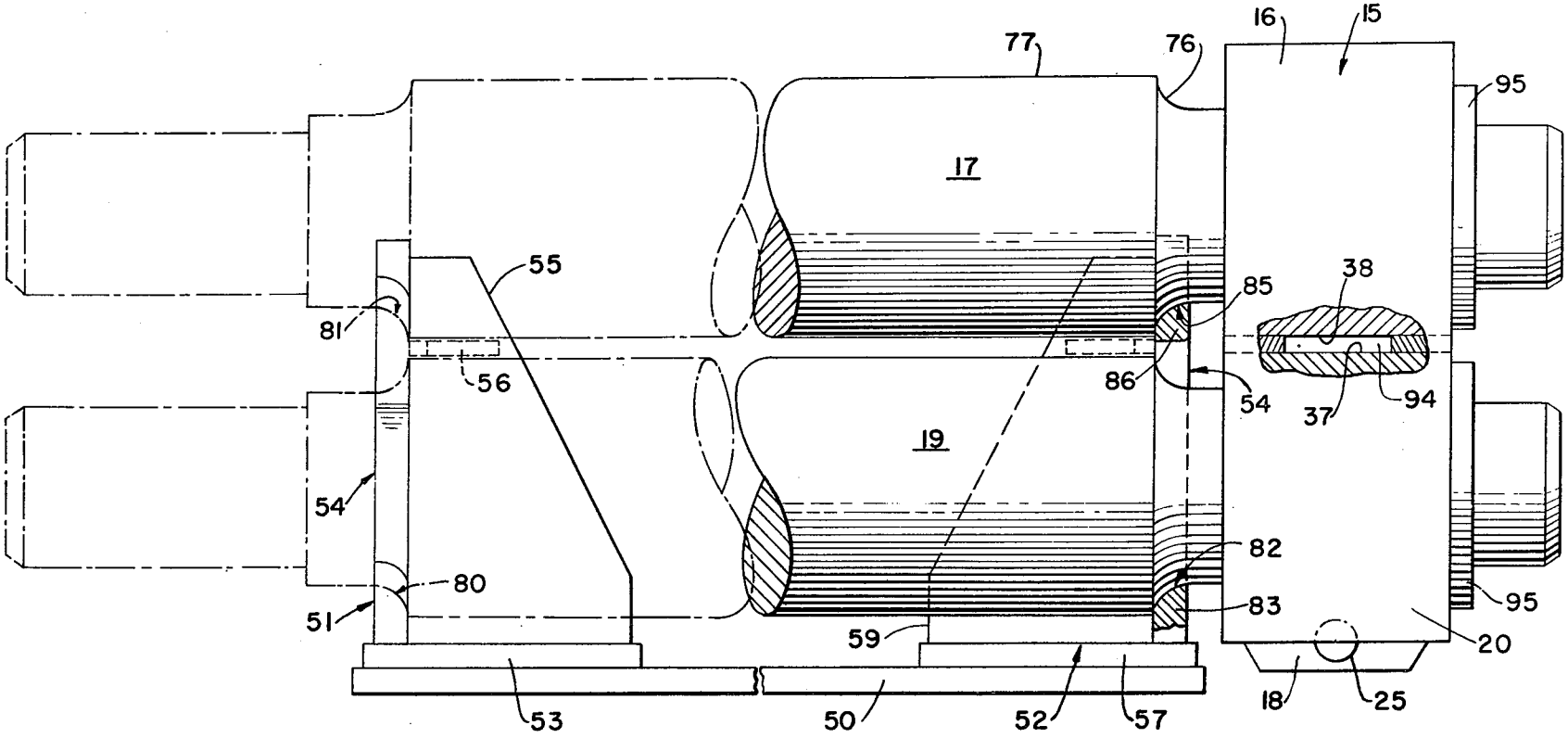
FIG. 3 is a diagrammatic view in side elevation, partially in section, of the dual work roll supporting device provided by the present invention in operative relation with top and bottom work rolls and a chock assembly.

As shown in FIG. 3, the dual work roll supporting device provided by the present invention includes a base structure 50 on which are mounted dual work roll end supports 51 and 52 in fixed relative relation to support the top work roll 17 and the bottom work roll 19 by contact with portions of the work rolls axially inwardly of each chock assembly in such a manner as to support the top and bottom work rolls within a chock assembly mounted on each of their ends, to permit each chock assembly to be removed as a unitary structure and to permit each removed chock assembly to be mounted as a unitary structure on the ends of top and bottom work rolls supported by a similar device. The dual work roll end support 51 includes a horizontal base plate 53, an upstanding member 54, a reinforcing plate 55 and a gusset plate 56 each fabricated from steel plate and joined together, such as by welding, to form a rigid structure. In like manner, the dual work roll end support 52 is a rigid structure including a horizontal base plate 57, an upstanding member 58, a reinforcing plate 59 and a gusset plate 60. The dual work roll end support 51 and 52 are mirror images of each other and details of both will be appreciated from FIGS. 4, 5, 6, and 7 which illustrate details of the work roll end support 51.

As shown in FIGS. 4, 5, 6, and 7, the upstanding member 54 includes a lower or first laterally extending porton 61 terminating in an end 62 and an upper or second laterally extending portion 63 terminating in an end 64, the extending portion 63 being located in spaced relation above the extending portion 61 to provide an openng 65 in the upstanding member which has a lateral entrance lying in a plane passing through the ends 62 and 64. The extending portions 61 and 63 have upwardly facing surfaces 66 and 67, respectively, and each upwardly facing surface includes a curved roll supporting surface having a center of curvature corresponding to the curvature of a portion of the rolls to be supported so that the curved roll supporting surface receives in snug supporting relation a curved surface of a roll to be supported. In particular, the roll supporting surface on the extension 61 lies between points 68 and 69 and has a center of curvature at point 70 while the roll supporting surface on the upper extending portion 63 lies between points 71 and 72 and has a center of curvature at point 73. The centers of curvatures 70 and 73 lie in a comon vertical plane 74 to permit support of the working rolls in the same relative position as exists when the working rolls are mounted in the rolling mill and the centers of curvature 70 and 73 are spaced height-wise to permit the work rolls to be supported when a clock assembly is mounted on each end of the work rolls and also to permit chock assemblies to be mounted on a pair of work rolls supported by a similar device. The arcuate dimensions of the roll supporting surfaces are sufficient to stably support the work rolls to permit chock assemblies to be removed from and mounted on supported work rolls. Roll supporting surfaces extending about 40 degrees from both sides of the plane 74 of the centers of curvature are adequate for supporting twenty-four inch diameter work rolls. However, the provision of the roll supporting surface 68–69 with the terminating point 69 lying in a horizontal plane passing through the center of curvature 70 aids in moving the lower work roll into supporting relation with the roll supporting surface 68–69.

The opening 65 in the upstanding member 54 is defined by the roll supporting surface extending between points 68 and 69 and by an upper non-roll supporting surface extending between the terminating end of the roll supporting surface at point 69 and point 75 at the end 64 of the extending portion 63. In order to permit the portion of the roll to be supported to pass through the entrance and enter the opening 65 and move into snug relation with the roll supporting surface of the extending portion 61, the non-roll supporting surface between points 69 and 75 is spaced from the center of curvature 70 at all points along the non-roll supporting surface a distance greater than the radius of curvature of the roll supporting surface 66–68 with the distance gradually increasing in a direction toward the point 75 to facilitate entrance of the surface of the roll to be supported into the opening 65 and into snug supporting relation with the roll supporting surface 68–69.

As shown in FIG. 3, conventional work rolls include a concave circumferential surface 76 outwardly of both ends of the working surface 77 of the rolls. In accordance with the principles of the present invention, the roll supporting surfaces 68–69 and 71–72 comprise convex surfaces curved to snugly contact a portion of the concave surface 76 of the rolls to be supported and the width of the supporting surfaces 68–69 and 71–72 between the sides 78 and 79 of the upstanding member 54 corresponds to the axial dimension of the concave surfaces 76 of the rolls. This feature provides support for the rolls in an axial direction which aids in removing and mounting chock assemblies as described below.

Figure 4:
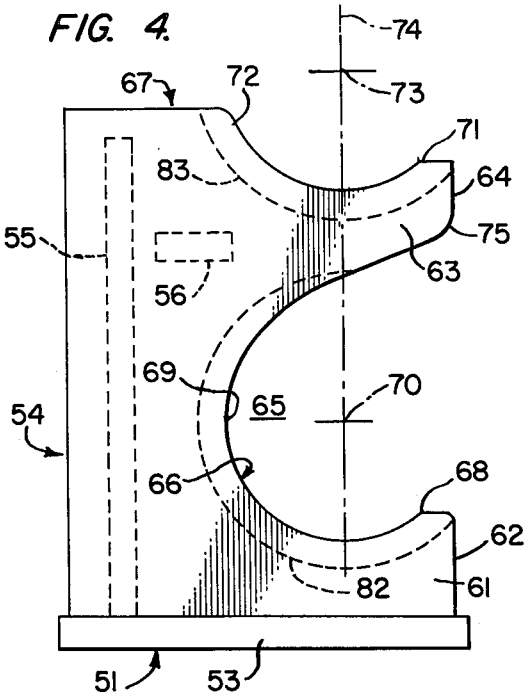
FIG. 4 is an end view of a dual roll end support forming a part of the device shown in FIG. 3.
Figure 5:
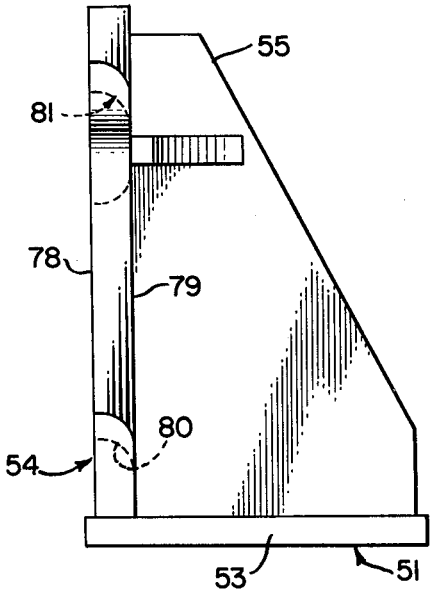
FIG. 5 is a view in side elevation of the dual roll end support shown in FIG. 4.
Figure 6:
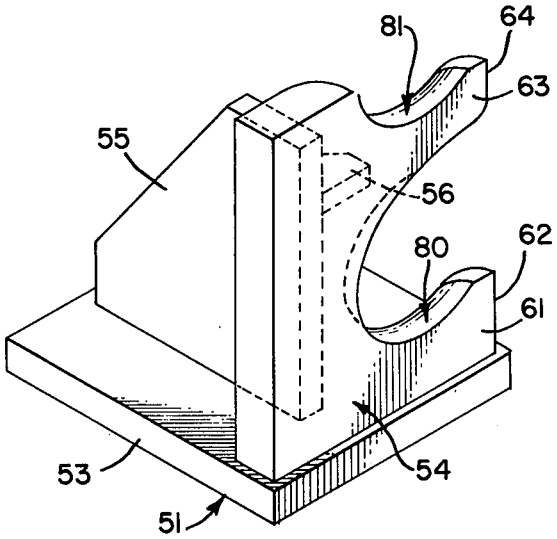
FIG. 6 is a three-dimensional view of the dual roll end support shown in FIGS. 4 and 5.
Figure 7:
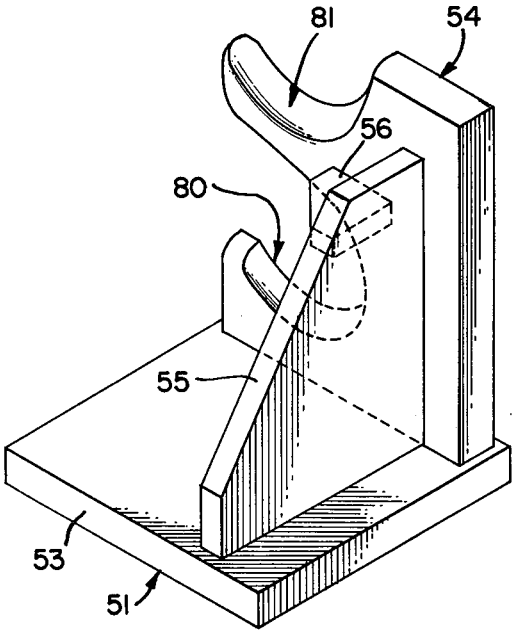
FIG. 7 is another three-dimensional view of the dual roll end support structure shown in FIGS. 4 and 5.

In FIGS. 5, 6 and 7, the convex roll supporting surface on the extending portion 61 is designated by reference character 80 and the convex roll supporting surface on the upper extending portion 63 is designated by the reference character 81. In FIG. 4, the dotted lines 82 and 83 identify the large diameter edges of the convex wall suppporting surfaces 80 and 81, respectively. The convex surface extends throughout the arcuate dimension of the roll supporting surfaces 68–69 and 71–72 and, as seen in FIG. 4, extend into the non-roll supporting surface 69–75 at least to the vertical plane 74 to permit free movement of the rolls to be supported into the opening 65. FIG. 3 shows the top and bottom work rolls 17 and 19 supported by the dual work roll end supports 51 and 52 with roll supporting surfaces in contact with the concave circumferential surfaces 76 at both ends of the rolls. In particular, a circumferential portion of the concave surface 76 at the left-hand end of the rolls, as viewed in FIG. 3, is supported by the convex roll supporting surfaces 80 and 81 and a circumferential portion of the concave surface 76 at the right-hand end of the rolls, as viewed in the drawing, is supported by convex roll supporting surfaces on the upstanding member 58 of the roll end supporting device 52; a convex roll supporting surface 82 being formed on the lower extension portion 83 of the upstanding member 58 and a convex roll supporting surface 85 being formed on the upper extending portion 86.

As shown in FIG. 3, the roll end supports 51 and 52 are secured to the base structure 50 with their upstanding members 54 and 58, respectively, lying in parallel planes which are spaced from each other by a distance equal to the axial length of the working surface 77 of the rolls 17 and 19. Also, the roll end supports 51 and 52 are positioned relative to each other so that the centers of curvature of the roll supporting surface on the lower extensions of both roll end supports lie on a common axis and so that the centers of curvatures of the roll supporting surfaces on the upper extensions of both roll end supports lie on a second common axis parallel to and spaced above the common axis of the centers of curvature of the lower roll supporting surfaces. For a purpose that will become apparent below, the vertical spacing between the parallel axes passing through the centers of curvature is less than the maximum vertical distance between the top surface 37 of the lower work roll chock 18 and the bottom surface 38 of the top work roll chock 16 which occurs when the chock assembly is supported by the upper work roll chock 16. As seen in FIG. 3, the reinforcing plates 55 and 59 extend from their respective upstanding members 54 and 58 toward each other and, as seen from FIG. 4, the reinforcing plates 55 and 59 lie in a plane displaced from the plane 74 of the centers of curvature to provide space for the working surface portion of the rolls to be supported between the upstanding members 54 and 58.

Figure 8:
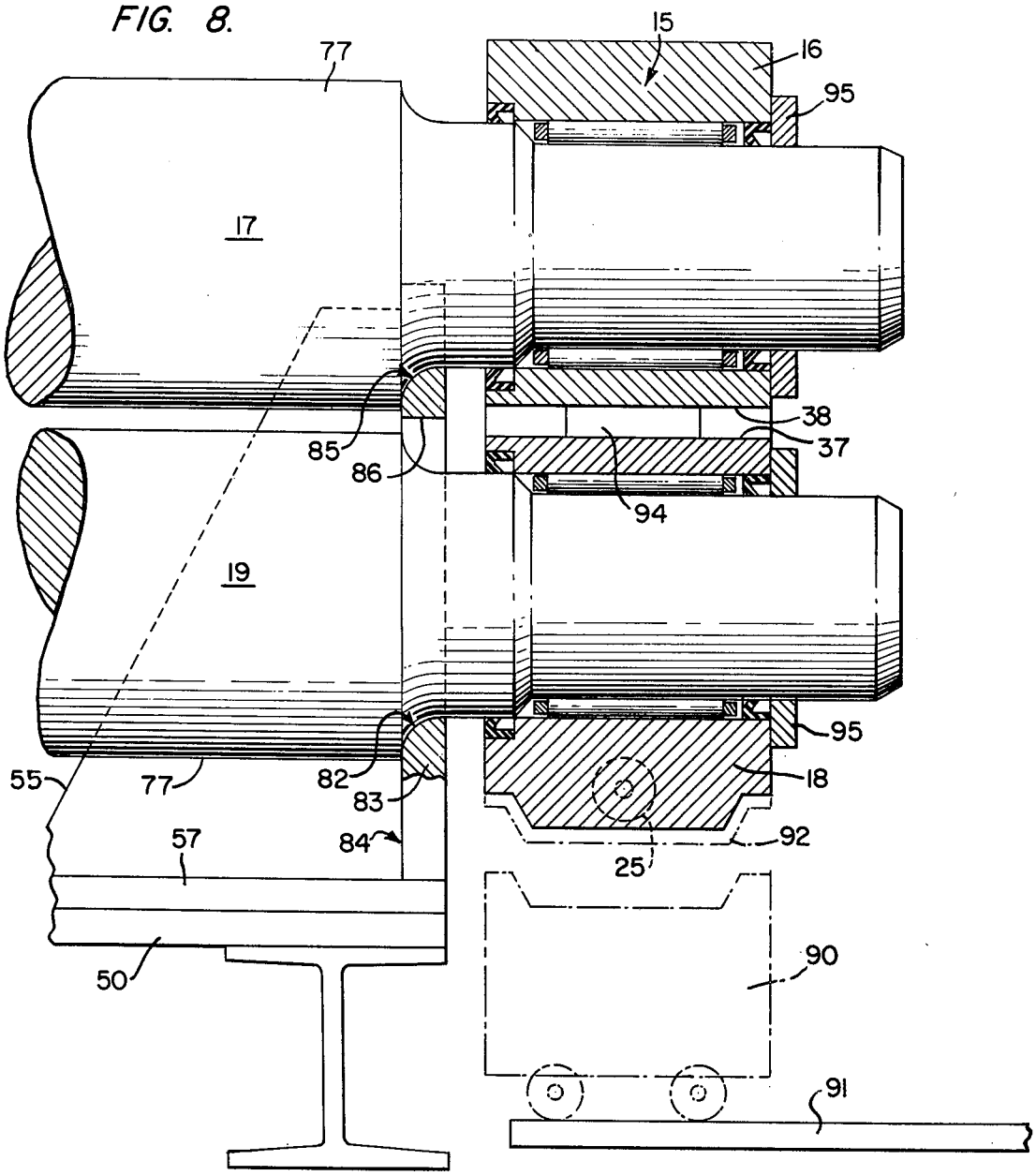
FIG. 8 is a diagrammatic view in elevation of the dual roll end support provided by the present invention in operative relation with top and bottom work rolls and a chock assembly.

In accordance with the principles of the present invention, a plurality of dual work roll supporting devices constructed in the manner described above and shown in FIG. 3 are mounted on a platform in spaced parallel relationship, that is, with the common axes passing through the center of curvatures of the roll supporting surfaces if each dual work roll supporting device lying in parallel planes which are spaced from each other by a distance sufficient to provide space for operations performed to remove chock assemblies from and mount chock assemblies on the supported top and bottom work rolls. Each of the plurality of dual work roll supporting devices have similar critical dimensions to support the top and bottom work rolls of a family of top and bottom work rolls having similar shapes and dimensions. In particular, each of the plurality of dual roll supporting devices have: roll supporting surfaces of similar radius of curvature comparable with the curvature of supported surfaces of the top and bottom work rolls; the same vertical distance between the center of curvature of the bottom roll supporting surface and the top roll supporting surface, and similar axial distances between the facing sides 78 and 79 of the upstanding members which correspond to the axial dimension of the working surface 77 of the rolls. At both sides of the platform, outwardly of and at an elevation below the roll end supporting devices 51 and 52 of each of the plurality of dual roll supporting devices, tracks are provided for supporting a chock car that is movable to positions adjacent each of the plurality of dual roll supporting devices such as a position beneath a chock assembly mounted on supported top and bottom work rolls for use in removing the chock assembly or a position outwardly from the ends of supported work rolls for use in mounting on the work rolls a chock assembly carried by the chock car. In FIG. 8 of the drawings, which is an enlarged view of the right-hand end of the dual work roll supporting device of FIG. 3 with the chock assembly 15 shown partly in cross section, a chock car 90 is shown mounted on rails 91 and located beneath the chock assembly 15 in a position to be moved upwardly to support the chock assembly 15 by engaging the lower work roll chock 18.

In practicing the method of the present invention, new or refinished work rolls are supported on one of the dual work roll supporting devices in the manner shown in FIG. 3 with the exception that the chock assembly 15 would not be present. This is accomplished by lifting the work rolls separately by use of a suitable sling into supporting engagement with the roll supporting surfaces; the lower work roll being moved laterally and downwardly into the opening 65 with the inclined surface between points 69 and 75, FIG. 4, aiding in guiding the lower work roll into supporting relation with the lower roll supporting surfaces. When a unitary structure comprising a pair of used work rolls with a chock assembly mounted at both ends, such as shown in FIG. 2, arrives from the rolling mill on the transport car, the unitary structure is lifted from the transport car by use of a suitable sling and mounted on another of the plurality of dual work roll supporting devices as shown in FIG. 3 with the exception that the chock assembly 15' would be mounted on the left-hand ends of the work rolls 17 and 18. The mounting operation is performed in a manner similar to the mounting of the new or refinished rolls on a dual roll supporting device, as described above; however, the top and bottom work rolls and the mounted chock assemblies 15 and 15' are lifted and mounted as a unitary structure.

When the unitary structure is mounted on a dual work roll supporting device, as shown in FIG. 3, since the roll supporting surfaces 80–82 and 81–85 snugly receive in supporting relation a portion of the concave surfaces 76 of the top and bottom work rolls, respectively, the longitudinal axis of the top work roll 17 and the central axes of the bearing surfaces of the top work roll chocks 16 and 16' pass through the centers of curvature of the work roll supporting surfaces 81 and 85 and the longitudinal axis of the lower work roll 19 and the central axes of the lower work roll chocks 18 and 18' pass through the centers of curvature of the work roll supporting surfaces 80 and 82. Furthermore, the longitudinal axes of the work rolls are spaced vertically from each other by a fixed distance determined by the vertical spacing between the centers of curvature 70 and 71 of the roll supporting surfaces. In each chock assembly, the lower work roll chocks are supported in fixed relation to the top work roll chock determined by the vertical distance between the centers of curvature 70 and 73. Since the vertical space between the centers of curvature is less than the vertical space between the central axes of the bearings of the upper and lower work roll chocks 16 and 18 when the lower chock is supported only by the upper chock, the vertical space between the top surface 37 of the bottom work roll chock 18 and the bottom surface 38 of the top work roll chock 16 is less than the vertical spacing that would exist if the lower work roll chock was free to reach its maximum downward position relative to the top work roll chock 16. This is shown in FIG. 8 wherein the dotted outline 92 represents the relative maximum downward position of the lower work roll chock if it was permitted to move freely relative to the top roll chock.

After the unitary assembly is moved to be supported by a dual work roll supporting device, a spacer or shim 94 is inserted in snug relation between the top surface 36 of the lower work roll chock 18 and the bottom surface 38 of the top work roll chock 16 in order to maintain constant the relative positions between the upper work roll chock 16 and the lower work roll chock 18 when the chock assembly 15 is supported by the lower work roll chock 18 and removed from the work rolls 17 and 19. In particular, with reference to FIG. 8, the chock car 90 is moved upwardly in contact with the lower work roll chock 18 to support the load of the chock assembly. Thereupon, after the thrust rings 95 are removed, the chock car is moved axially away from the work rolls while at the same time a lateral force is applied to the chock assembly by means not shown to move the chock assembly from the work rolls. The removed chock assembly is then moved by the chock car to a position adjacent the ends of the new or refinished rolls supported by the dual work roll supporting device discussed above. Since the longitudinal axis of the new or refinished work rolls and the central axes of the bearings of the chock assembly are equally vertically spaced, due to the presence of the spacer 94, an inward lateral force is applied to the chock assembly and the chock car is moved inwardly to mount the chock assembly on the new or refinished work rolls. Thereafter, the spacer 94 is removed and the thrust rings 95 replaced and, when a chock assembly is mounted on the other ends of the work rolls, the unitary assembly is lifted from the dual work roll device, placed on the transport car and moved to the rolling mill.

The present invention thus provides a four-step process for changing chock assemblies, i.e., (1) mounting new or refinished work rolls on a dual work roll supporting device; (2) mounting as a unitary structure used work rolls and chock assemblies on a dual work roll supporting device; (3) removing chock assemblies as unitary structures from the used work rolls and mounting such chock assemblies on the supported new or refinished work rolls; and (4) removing from the dual work roll supporting device the new unitary structure comprising new or refinished work rolls and mounted chock assemblies.

There is thus provided by the present invention a novel method and apparatus which greatly simplifies the operations and materially reduces the time previously required for changing chock assemblies from used work rolls to new or refinished work rolls. It will be appreciated that features and details of the preferred embodiment disclosed and described herein may be modified without departing from the spirit of the invention. For example, the roll supported surfaces of the dual roll supporting device may be shaped to conform to other surfaces of the work rolls such as the marginal edges of the working surface of the rolls or the constant diameter portion of the rolls between the chock assemblies and the concave circumferential surface. Accordingly, reference will be had to the accompanying claims for a definition of the limits of the invention.

What is claimed is:

1. The method of removing chock assemblies from used top and bottom work rolls and of mounting such chock assemblies on new or refinished top and bottom work rolls, each chock assembly being of the type including a top work roll chock and a bottom work roll chock which is movable downwardly a predetermined extent relative to the top work roll chock so that the bottom surface of the top work roll chock is spaced above the top surface of the bottom work roll chock by a predetermined distance when the chock assembly is supported by the top work roll chock, said method comprising the steps of:

*a.* supporting as a unitary structure top and bottom used work rolls and chock assemblies mounted thereon by contact with surfaces of both of the rolls axially inwardly of both chock assemblies with the longitudinal axes of the work rolls positioned one above the other by a fixed distance,

*b.* supporting new or refinished top and bottom work rolls adapted to have chock assemblies mounted thereon, the work rolls being supported by contact with surfaces of both of the work rolls at both ends of the work rolls inwardly of the portions of the work rolls over which mounted chock asemblies extend with the longitudinal axes of the work rolls positioned one above the other by a distance equal to the fixed distance, c. inserting a shim between the top surface of the bottom work roll chock and the bottom surface of the top work roll chock of both chock assemblies when the top and bottom work rolls and mounted chock assemblies are supported as a unitary structure by step (*a*), the shim being of a thickness to snugly fit between the bottom surface of the top wall roll chock and the top surface of the bottom work roll chock,

*d.* removing the chock assemblies from the used work rolls and mounting the chock assemblies on the supported new or refinished work rolls by use of a chock car which supports the respective chock assemblies by contact with the bottom work roll chock; and

*e.* removing the shim from between the bottom surface of the top work roll chock and the top surface of the bottom work roll chock of each chock assembly after the clock assembly is mounted on the new or refinished work rolls.

2. Method of removing and mounting chock assemblies as defined in claim 1 in which the chock assemblies are removed from the used work rolls by use of a chock car and transported by the chock car to the supported new or refinished work rolls and mounted on the new or refinished work rolls by use of the chock car.

3. Method of removing and mounting chock assemblies as defined in claim 1 in which the fixed distance between the longitudinal axes of the work rolls when supported according to steps (*a*) and (*b*) is less than the predetermined distance between the bottom surface of the top work roll chock and the top surface of the bottom work roll chock when each chock assembly is supported by its top work roll chock.

4. In a rolling mill system including at least one dual roll assembly having a pair of overlaying rolls supported for rotation about spaced parallel horizontal axes by a pair of chock units one at each of the pair of rolls, the rolls having main body portions and reduced diameter end portions forming shoulders at the junction with the body portions, the end portions being received in the chock units and forming open recesses between the shoulders and the chocks, the chocks being axially removable from and inseratable on the end portions of the rolls to permit removal and replacement of the rolls, and support means for supporting said rolls independently of said chocks, said support means including a base structure, a pair of roll end supports each including a base plate and an upstanding member mounted on the base plates including a pair of height-wise spaced curved roll-supported surfaces each having a radius of curvature correponding to the radius of curvature of one portion of the roll to be supported, the base plate of both roll end supports being secured to the base structure with the centers of curvature of pair of corresponding roll-supporting surfaces of both roll end supports lying on a common horizontal axis and with the common axis of one pair of corresponding roll-supporting surfaces disposed above in a common vertical plane with the common axis of the other pair of corresponding roll-supporting surfaces

5. The rolling mill system defined in claim 4, wherein the radius of curvature of the roll-supporting surfaces corresponds to the radius of curvature of said reduced diameter portion of said rolls, said upstanding member adpated to engage said shoulder on said rolls adjacent said roll-supporting surfaces to thereby support the rolls against lengthwise movement during installation and removal of the chock assemblies.

6. In combination with a dual roll assembly including a pair of generally parallel overlying rolls and a pair of chock units supporting opposite ends of the rolls for rotation about horizontal axes, the rolls having main body portions and reduced diameters at their opposite ends which are received in the chock units forming recesses between the main body portions and the chock units, the chock units being axially removably from and insertable on the rolls for permitting repair or replacement of the rolls in the chock units; supporting means received under each of said rolls and in said recesses to hold the rolls independently of the chock units in generally horizontal plane and to prevent axial movement of the rolls during removal or insertion of the chock units relative to the rolls, said support means including first and second pair of arcuate supporting surfaces dimensioned to conform to the curvature of the reduced diameter end portions of the rolls.

7. The combination defined in claim 6 wherein said arcuate surfaces are convex in cross section and wherein the recesses at the opposite ends of the rolls are concave in profile to complement the arcuate surfaces.

* * * * *

UNITED STATES PATENT OFFICE
CERTIFICATE OF CORRECTION

Patent No. 4,026,136 Dated May 31, 1977

Inventor(s) Raymond H. Pell

It is certified that error appears in the above-identified patent and that said Letters Patent are hereby corrected as shown below:

Col. 2, line 68, "openings" should be -- opening --;
Col. 3, line 11, "closest" should be -- closed --;

Col. 4, line 6, "within" should be -- with --;

Col. 4, line 45, "comon" should be -- common --;
Col. 5, line 34, "suppporting" should be -- supporting --;
Col. 5, line 37, "extend" should be -- extends --;
Col. 6, line 23, "center" should be -- centers --;
Col. 7, line 52, after "top" and before "roll", insert -- work --;
Col. 8, line 39, "supported" should be -- supporting --;
Col. 9, line 15, "wall" should be -- work --;
Col. 9, line 26, "clock" should be -- chock --;
Col. 9, line 46, after "each" and before "of", insert -- end --;

UNITED STATES PATENT OFFICE

CERTIFICATE OF CORRECTION

Patent No. 4,026,136 Dated May 31, 1977

Inventor(s) Raymond H. Pell

It is certified that error appears in the above-identified patent and that said Letters Patent are hereby corrected as shown below:

Col. 10, line 1, "inseratable" should be -- insertable --;
Col. 10, line 8, "supported" should be -- supporting --;
Col. 10, line 13, "pair" should be -- pairs --;
Col. 10, line 16, after "above", insert -- and --;
Col. 10, line 23, "adpated" should be -- adapted --;
Col. 10, line 36, "supporting" should be -- support --;
Col. 10, line 38, after "in" and before "gen-", insert -- a --.

Signed and Sealed this

Eighth Day of November 197

[SEAL]

Attest:

RUTH C. MASON
Attesting Officer

LUTRELLE F. PARKER
Acting Commissioner of Patents and Trademar